US010022290B2

(12) United States Patent
Ma et al.

(10) Patent No.: US 10,022,290 B2
(45) Date of Patent: Jul. 17, 2018

(54) MULTIFUNCTIONAL HEAD MASSAGER

(71) Applicant: SHENZHEN BREO TECHNOLOGY CO., LTD., Shenzheng (CN)

(72) Inventors: Xuejun Ma, Shenzhen (CN); Yong Wan, Shenzhen (CN)

(73) Assignee: SHENZHEN BREO TECHNOLOGY CO., LTD., Shenzheng (CN)

( * ) Notice: Subject to any disclaimer, the term of this patent is extended or adjusted under 35 U.S.C. 154(b) by 743 days.

(21) Appl. No.: 14/423,179

(22) PCT Filed: Apr. 16, 2014

(86) PCT No.: PCT/CN2014/075445

§ 371 (c)(1),
(2) Date: Feb. 23, 2015

(87) PCT Pub. No.: WO2015/074373

PCT Pub. Date: May 28, 2015

(65) Prior Publication Data

US 2016/0008209 A1 Jan. 14, 2016

(30) Foreign Application Priority Data

Nov. 25, 2013 (CN) ..... 2013 1 0603287

(51) Int. Cl.
*A61H 9/00* (2006.01)
*A61H 7/00* (2006.01)
*A61H 21/00* (2006.01)

(52) U.S. Cl.
CPC ..... *A61H 9/0078* (2013.01); *A61H 7/006* (2013.01); *A61H 21/00* (2013.01);
(Continued)

(58) Field of Classification Search
CPC ..... A61H 5/00; A61H 9/0078; A61H 7/006; A61H 7/007; A61H 2205/02
See application file for complete search history.

(56) References Cited

U.S. PATENT DOCUMENTS 8,491,505 B2 * 7/2013 Yang ..... A61H 23/0263 601/15
2006/0161200 A1 * 7/2006 Fallah ..... A61H 1/0292 606/204.15

(Continued)

FOREIGN PATENT DOCUMENTS

CN 201320276 10/2009
CN 201394167 2/2010

(Continued)

OTHER PUBLICATIONS

English translation of CN201394167, Feb. 3, 2010, pp. 1-4.*
English translation of CN201426830, Mar. 24, 2010, pp. 1-7.*

*Primary Examiner* — Justine Yu
*Assistant Examiner* — Kathrynn Lyddane
(74) *Attorney, Agent, or Firm* — Hamre, Schumann, Mueller & Larson, P.C.

(57) ABSTRACT

Embodiments of a multifunctional head massager are disclosed. The multifunctional head massages includes a helmet including a front shell and a rear shell, and a controller connected to the helmet. A blinder for massaging eyes is detachably connected to the front shell. In the present invention, the blinder is detachably connected to the front shell, so that the head massager has the eye massage function at the same time. When users do not want to massage their eyes, the blinder can be removed, and the head massage function is not affected.

7 Claims, 8 Drawing Sheets

(52) U.S. Cl.
CPC ..... *A61H 2201/0103* (2013.01); *A61H 2201/0184* (2013.01); *A61H 2201/0192* (2013.01); *A61H 2201/0207* (2013.01); *A61H 2201/5043* (2013.01); *A61H 2201/5074* (2013.01); *A61H 2205/02* (2013.01); *A61H 2205/024* (2013.01); *A61H 2205/025* (2013.01); *A61H 2230/207* (2013.01)

(56) References Cited

U.S. PATENT DOCUMENTS

| | | | | |
|---|---|---|---|---|
| 2006/0200052 | A1* | 9/2006 | Lin | A61H 5/00 601/70 |
| 2007/0088234 | A1* | 4/2007 | Tseng | A61H 7/006 601/151 |
| 2010/0113991 | A1* | 5/2010 | Wu | A61H 7/006 601/46 |
| 2013/0102937 | A1* | 4/2013 | Ehrenreich | A61H 1/00 601/47 |
| 2013/0253389 | A1* | 9/2013 | Juto | A61H 23/04 601/48 |

FOREIGN PATENT DOCUMENTS

| | | |
|---|---|---|
| CN | 201426830 | 3/2010 |
| CN | 101785740 | 7/2010 |
| CN | 201939690 | 8/2011 |
| CN | 103622809 | 3/2014 |

* cited by examiner

MULTIFUNCTIONAL HEAD MASSAGER

TECHNICAL FIELD

The present invention relates to the technical field of massagers, in particular, to a multifunctional head massager.

BACKGROUND

Generally, an existing head massager only massages acupoints on heads, its function is single, and the massager is unable to meet the consumers' diverse needs, so it needs to be improved.

BRIEF SUMMARY OF THE INVENTION

The technical problem to be solved by the present invention is to overcome the defect in the prior art, and to provide a head massager with both head massage function and eye massage function.

In order to solve the above mentioned technical problem, a technical solution of the present invention is to provide a multifunctional head massager, which includes a helmet comprising a front shell and a rear shell, and a controller connected to the helmet; wherein a blinder capable of massaging eyes is detachably connected to the front shell.

Specifically, the blinder comprises an eye housing and a massage airbag accommodated in the eye housing, the eye housing is provided with a pipe joint communicating with the massage airbag, a pump is accommodated in the front shell, the front shell is provided with an air tap communicating with the pump, and the pipe joint is inserted in the air tap.

Furthermore, a sealing ring is disposed between the air tap and pipe joint.

Specifically, a first PCB is disposed on the front shell, a second PCB is disposed on the eye housing, the eye housing is provided with a plurality of pins capable of passing through the second PCB, the second PCB is electrically connected to the first PCB through the pins.

Furthermore, each of the pins has a contact terminal, and a first elastic member is accommodated in each contact terminal to press the contact terminal against and thereby electrically connect the contact terminal to the first PCB.

Specifically, each of two end faces of the eye housing is provided with a lock hole, and the front shell is provided with two lock components capable of being inserted in the lock holes.

Specifically, the front shell is provided with a mounting groove, the lock component comprises a lock catch accommodated in the mounting groove and being movable forward and backward, and a second elastic member disposed behind the lock catch to press against the lock catch; a front portion of the lock catch is provided with an inserting part, and the inserting part extends from the mounting groove and is inserted in the lock hole.

Furthermore, the multifunctional head massager further comprises a blood oxygen detecting device, wherein the blood oxygen detecting device is accommodated in the front shell or the eye housing, and the blood oxygen detecting device is electrically connected to the controller.

Specifically, the blood oxygen detecting device comprises a flexible sleeve fixed in the helmet, a third elastic member disposed in the flexible sleeve, and at least one blood oxygen sensor disposed on the third elastic member.

Specifically, an open portion at an upper end of the flexible sleeve is provided with a connection block, the blood oxygen sensor is disposed on the connection block, a lower support is disposed below the connection block, the blood oxygen sensor is provided with an upper support, the upper support passes through the connection block and is engaged with the lower support, the upper support is provided with an aperture, the blood oxygen sensor is exposed from the aperture, and the third elastic member is fixed on the lower support.

In the present invention, the detachable blinder makes the massager not only have head massager function, but also have eye massage function. When the user doesn't need eye massage function, he/she can remove the whole blinder, and the head massage function is not affected. Therefore, the structure integrating the eye massage function with the head massage function is more convenient for the users.

DETAILED DESCRIPTION OF THE INVENTION

To make the objectives, technical solutions and advantages of the present invention be clearer, the present invention will be further described hereafter with reference to the accompany drawings and embodiments. It shall be understood that, the embodiments described herein are only intended to illustrate but not to limit the present invention.

Figure 1:
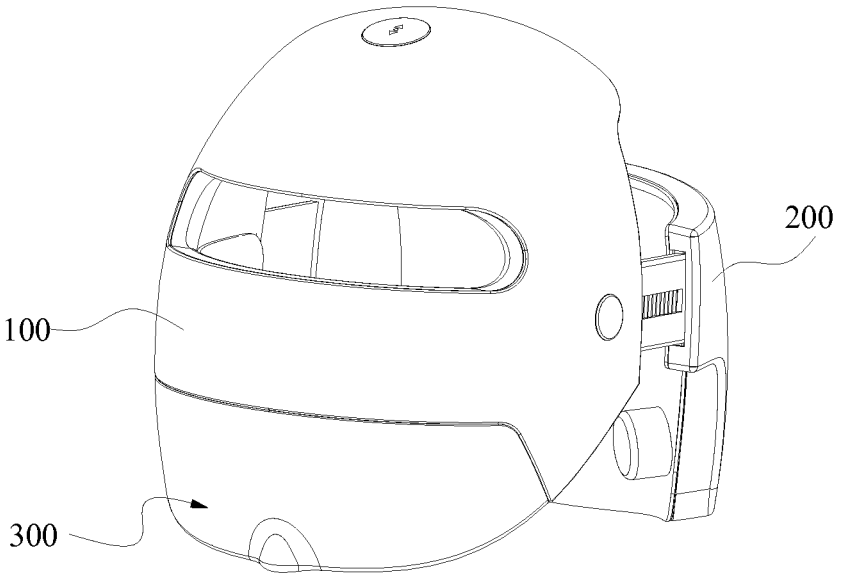
FIG. 1 is a structural schematic view of a multifunctional head massager according to an embodiment of the present invention.
Figure 2:
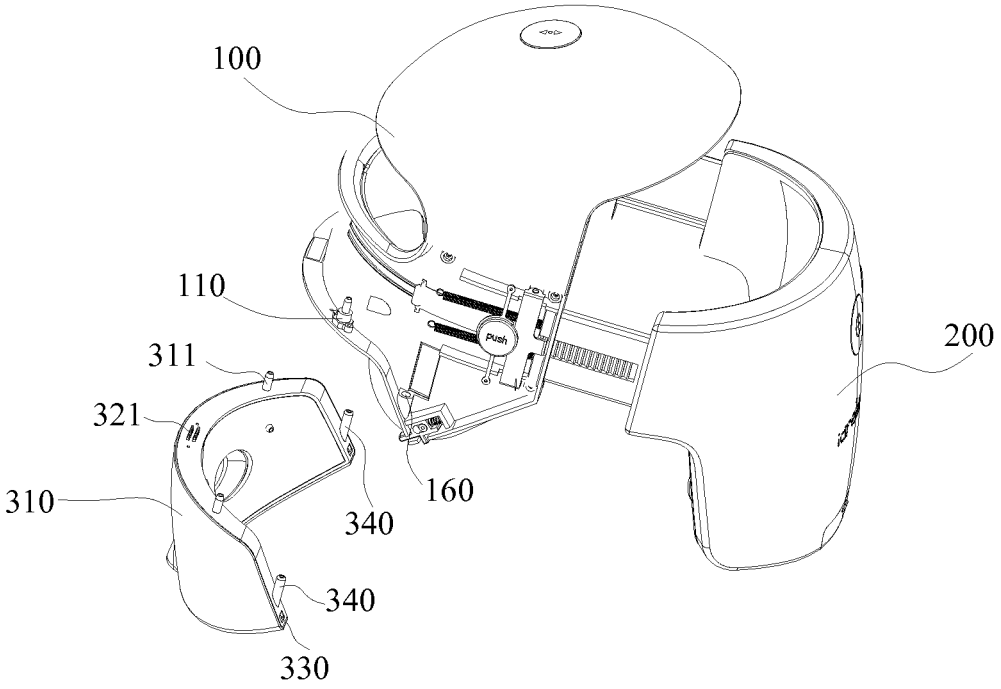
FIG. 2 is a structural schematic view of the multifunctional head massager according to an embodiment of the present invention, from which the blinder is removed.
Figure 3:
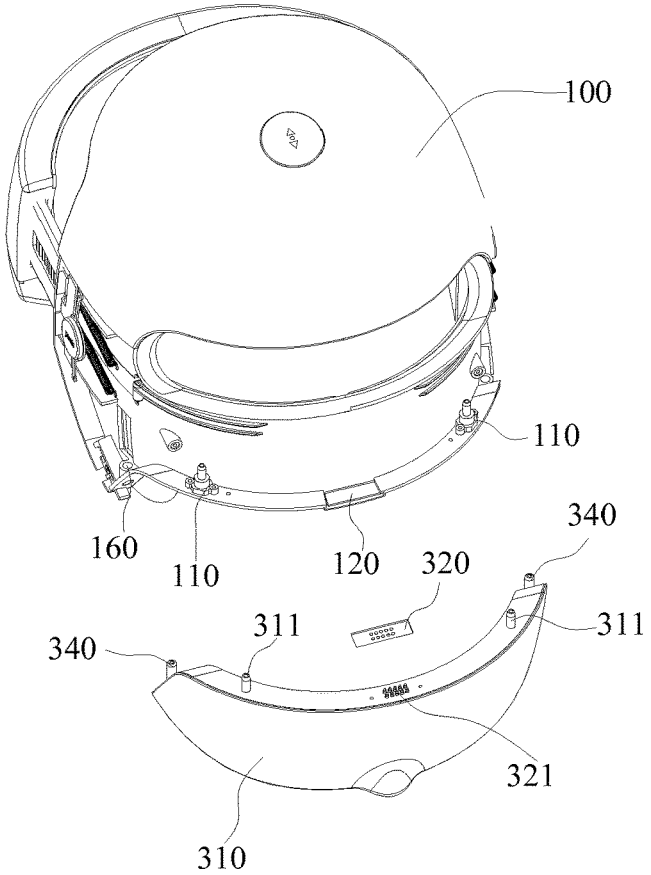
FIG. 3 is another schematic view from another angle of the multifunctional head massager according to an embodiment of the present invention, from which the blinder is removed.
Figure 4:
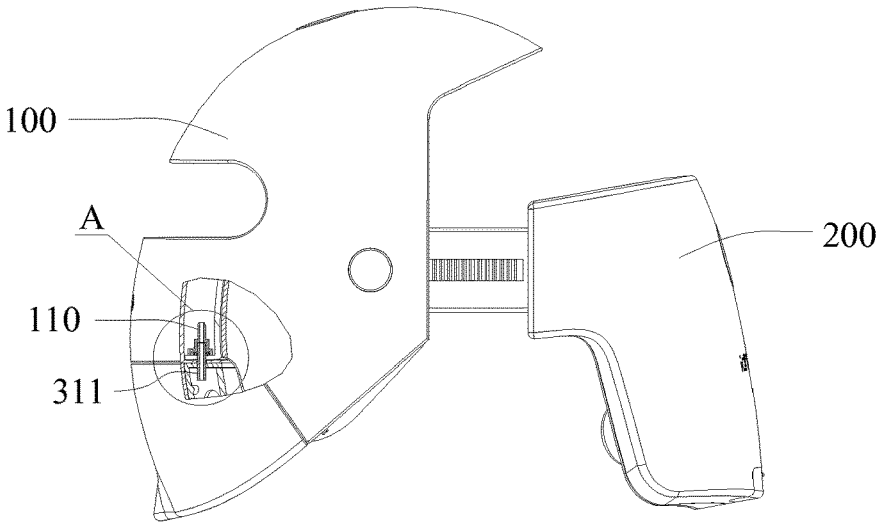
FIG. 4 is a partial cross-section view I of the multifunctional head massager according to an embodiment of the present invention.
Figure 15:
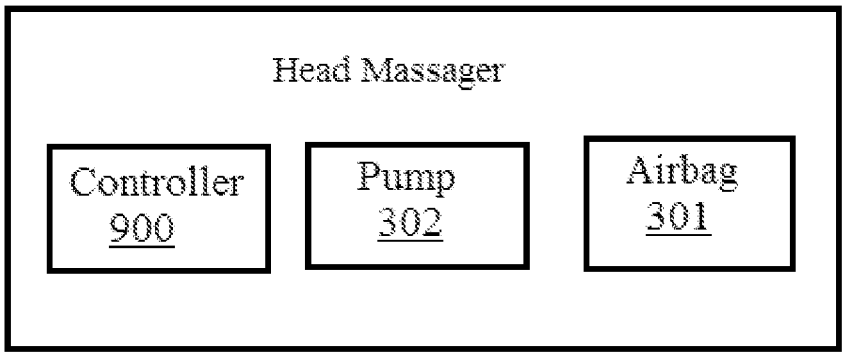
FIG. 15 depicts a block diagram of the multifunctional head massager according to an embodiment of the present invention.

FIGS. 1-3 are structural schematic views of a multifunctional head massager according to a preferred embodiment of the present invention. The multifunctional head massager comprises a helmet comprising a front shell 100 and a rear shell 200, also referring to FIG. 15, a controller 900 connected to the helmet can also be included by the multifunctional head massager; wherein a blinder 300 capable of massaging eyes is detachably connected to the front shell 100. In the present invention, the detachable blinder 300 makes the massager not only have head massager function, but also have eye massage function. When the user does not need eye massage function, he/she can remove the whole blinder 300, and the head massage function is not affected. Therefore, the structure integrating the eye massage function with the head massage function is more convenient for the users.

Referring to FIGS. 2-4 and FIG. 15, the blinder 300 comprises an eye housing 310, and can also include a massage airbag 301 accommodated in the eye housing 310. The blinder 300 mainly massages eyes by charging and discharging the massage airbag, and the eye housing 310 is provided with a pipe joint 311 communicating with the massage airbag. Accordingly, a pump 302 is accommodated in the front shell 100, and the front shell 100 is provided with an air tap 110 communicating with the pump. The pipe joint 311 of the blinder 300 is inserted in the air tap 110. Thus, through the communication between the pipe joint 311 and air tap 110, gas transmission may be achieved.

Figure 5:
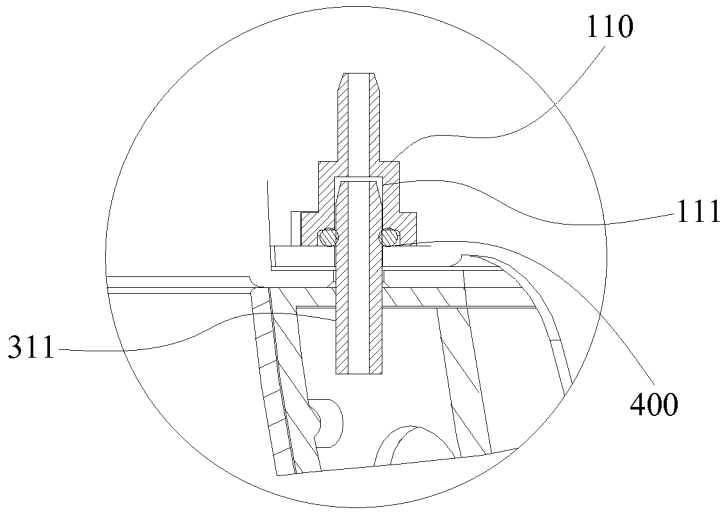
FIG. 5 is an enlarged view of the part A in FIG. 4.

Preferably, referring to FIG. 5, the air tap 110 is disposed on the front shell 100, the bottom of the air tap 110 is provided with an insertion slot 111, the pipe joint 311 is inserted into the air tap 110 via the insertion slot 111, and a sealing ring 400 is disposed between the insertion slot 111 and the pipe joint 311. Thus, the seal level between the insertion slot 111 and the pipe joint 311 is improved, and gas leakage can be prevented.

Figure 6:
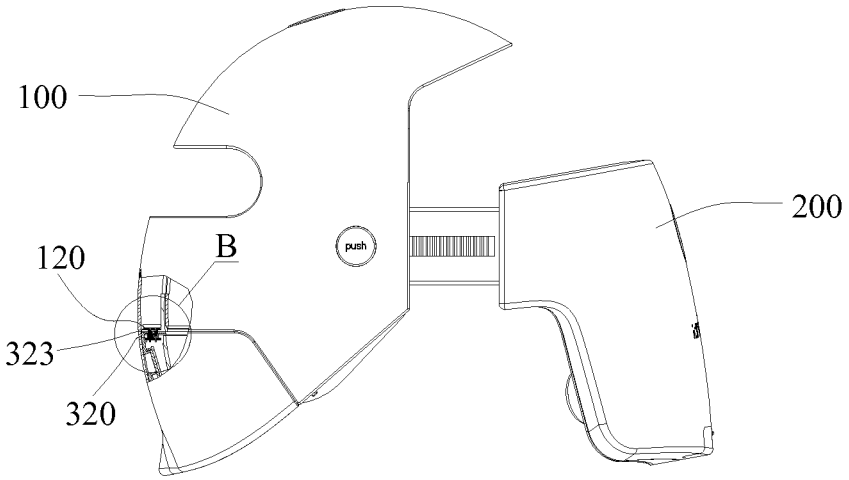
FIG. 6 is a partial cross-section view II of the multifunctional head massager according to an embodiment of the present invention.
Figure 7:
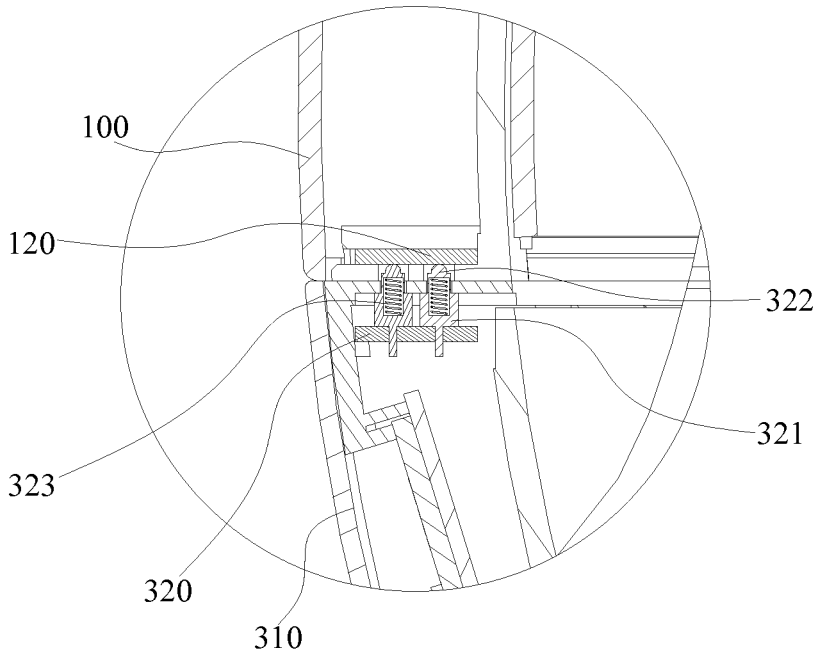
FIG. 7 is an enlarged view of the part B in FIG. 6.

Referring to FIGS. 2, 6, and 7, in this embodiment, the front shell 100 is provided with a first PCB 120, and the eye housing 310 is provided with a second PCB 320. The eye housing 310 is provided with a plurality of pins 321 passing through the second PCB 320, and the second PCB 320 is electrically connected to the first PCB 120 through the pins 321. Specifically, the top of each of the pins 321 is provided with a contact terminal 322, and a first elastic member 323 is accommodated in each contact terminal 322. Preferably, the first elastic member 323 is a spring. In this way, under the pressure of the spring, the contact terminal 322 can always keep stable electric connection with the first PCB 120. The second PCB 320 is electrically connected to the first PCB 120 via the pins 321, and can also heat the eyes.

Figure 8:
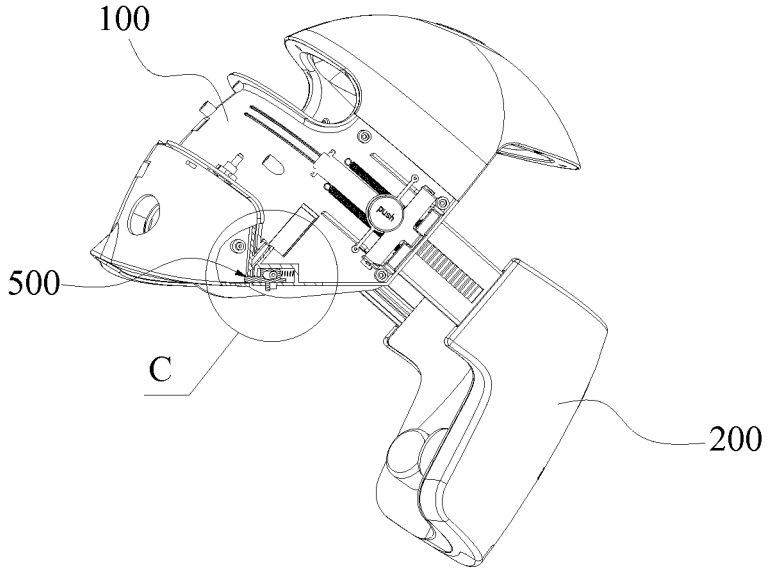
FIG. 8 is partial cross-section view III of the multifunctional head massager according to an embodiment of the present invention.
Figure 9:
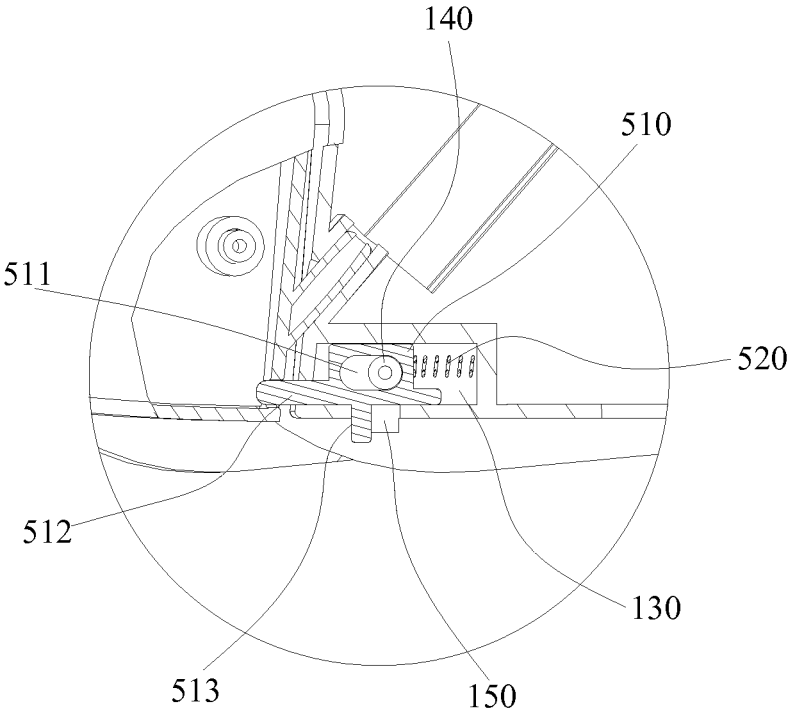
FIG. 9 is an enlarged view of the part C in FIG. 8.

In this way, through the above connection structure, gas path connection and circuit connection between the blinder 300 and the helmet are achieved. A detachable connection structure for the blinder 300 and the helmet includes two groups of reciprocal lock holes and lock components. Referring to FIGS. 2, 8, and 9, the two lock holes 330 are respectively disposed on two end faces of the eye housing 310, and the two lock components 500 are respectively disposed on an end face of the front shell 100. The front shell 100 is provided with two mounting grooves 130, and each mounting groove 130 accommodates a limiting post 140. Each lock component 500 comprises a lock catch 510 accommodated in one of the mounting grooves 130 and a second elastic member 520 disposed behind the lock catch 510 for pressing against the lock catch 510. Specifically, the second elastic member 520 is a spring. Each lock catch 510 is provided with a strip-shaped groove 511, the limiting post 140 is inserted in the strip-shaped groove 511, and the lock catch 510 is movable forward and backward in the limitation range of the limiting post 140. A front portion of the lock catch 510 is provided with an inserting part 512, and the inserting part 512 extends from the mounting groove 130 and is inserted in the lock hole 330. The bottom of the lock catch 510 is provided with a toggle part 513, the bottom of the mounting groove 130 is provided with a gap 150, and the toggle part 513 is movable in the gap 150.

In this embodiment, in order to ensure the reliability of the connection between the blinder 300 and front shell 100, the front shell 100 is further provided with a location hole 160, and the eye housing 310 is provided with a location column 340, correspondingly. The blinder 300 and the front shell 100 can be positioned and connected together quickly by inserting the location column 340 into the location hole 160.

Figure 10:
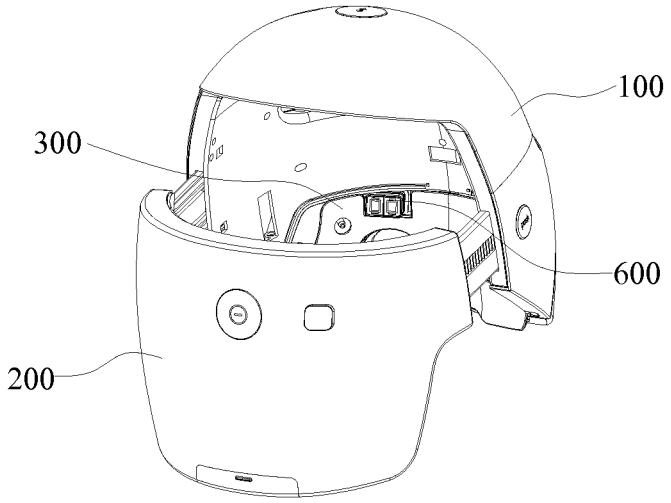
FIG. 10 is a view from another angle of the multifunctional head massager according to an embodiment of the present invention.

Furthermore, referring to FIG. 10, in this embodiment, a blood oxygen detecting device 600 is accommodated inside the blinder 300, and the blood oxygen detecting device 600 is electrically connected to the controller. Understandably, the blood oxygen detecting device 600 may also be disposed inside the front shell 100. When the blinder 300 is mounted to massage, the blood oxygen detecting device 600 can cling to the user's forehead, detect the user's blood oxygen concentration data, and display the data by the controller in real time. It is convenient for users to know the blood oxygen situation and thereby adjust the head massager properly. For some users suffering from disease, real-timely detected blood oxygen data can play a role in warning and guidance.

Figure 11:
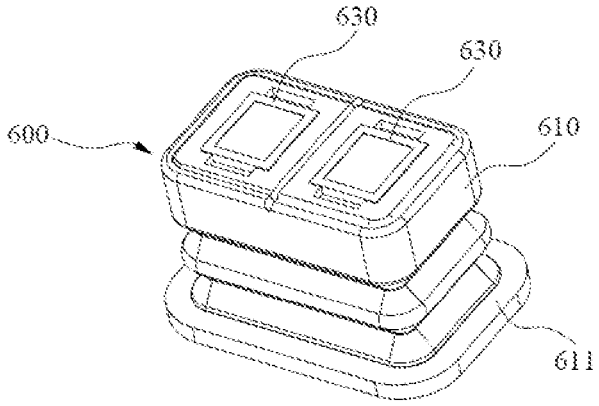
FIG. 11 is a structural schematic view of a blood oxygen detecting device according to an embodiment of the present invention.
Figure 12:
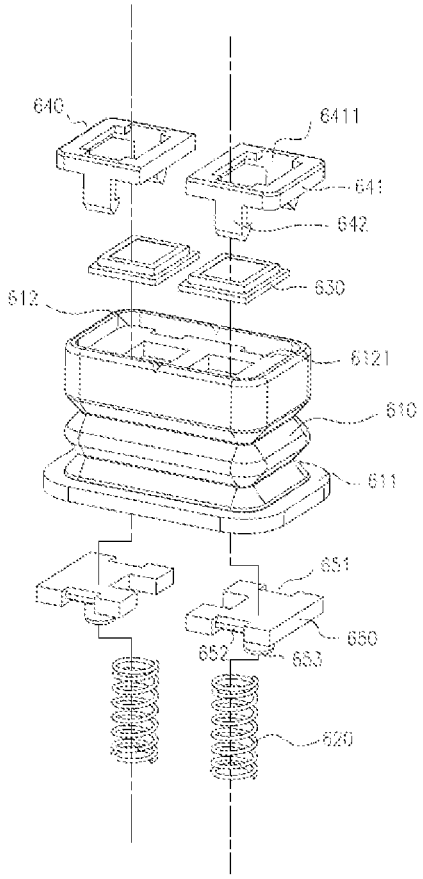
FIG. 12 is an explosive view of the blood oxygen detecting device according to an embodiment of the present invention.
Figure 13:
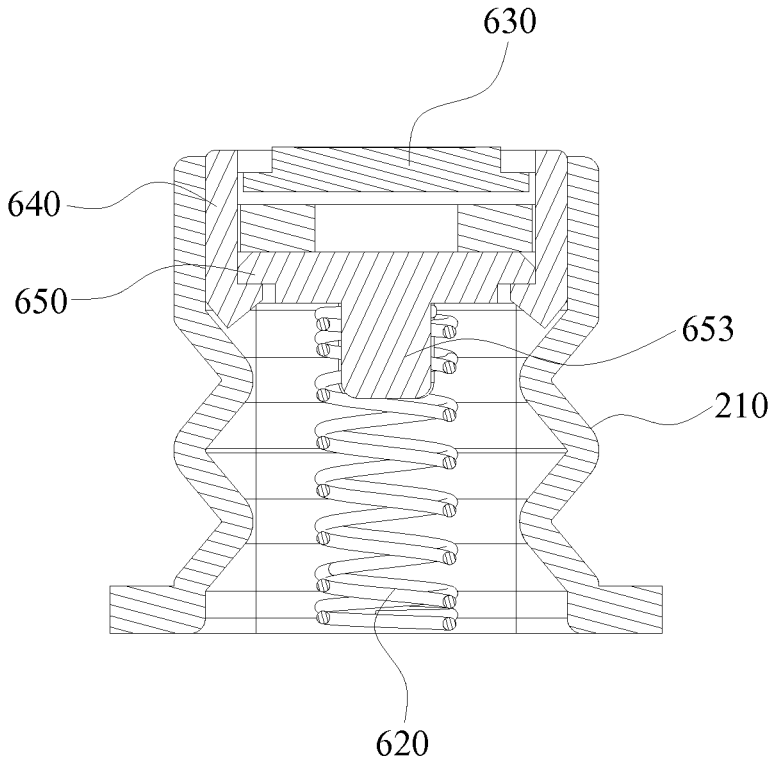
FIG. 13 is a cross-section view I of the blood oxygen detecting device according to an embodiment of the present invention.
Figure 14:
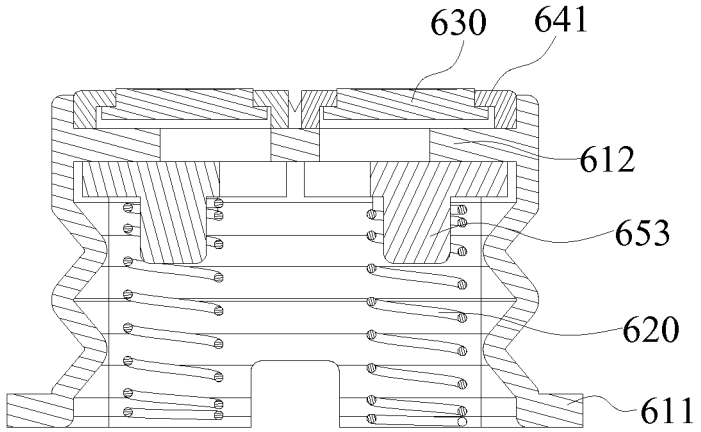
FIG. 14 is a cross-section view II of the blood oxygen detecting device according to an embodiment of the present invention.

Referring to FIG. 11 and FIG. 14, the blood oxygen detecting device 600 comprises a flexible sleeve 610, a third elastic member 620 disposed in the flexible sleeve 610, and two blood oxygen sensors 630 disposed on the third elastic member 620. In this way, the whole blood oxygen detecting device 600 can stretch and shrink freely. When the head massager is used by different persons respectively, the blood oxygen detecting device 600 stretches or shrinks according to different head sizes, which ensures that the blood oxygen sensor 630 always clings to the human body skin and further ensures the accuracy of the test. In this embodiment, in order to ensure good flexibility of the flexible sleeve 610, the flexible sleeve 610 is made of flexible glue and uses wavy design, so the flexible sleeve 610 itself has extensibility and can be prevent from deviating to some extent during stretch and shrink. In this embodiment, the blood oxygen detecting device 600 is fixed on an inner side of the eye housing 310 through the flexible sleeve 610. Specifically, the bottom edge of the flexible sleeve 610 is provided with a flange 611, and the inner side of the eye housing 310 is correspondingly provided with a clamping slot (not shown) for clamping the flange 611, so that the flexible sleeve 610 is fixed, and the blood oxygen detecting device 600 is further fixed.

An upper open 150 of the flexible sleeve 610 is provided with a connection block 612, the connection block 612 and the open 150 of the flexible sleeve 610 from a cavity, and the blood oxygen sensor 630 is accommodated in the cavity and is fixed by an upper support 640 and a lower support 650. The third elastic member 620 is disposed in the space below the connection block 612.

The upper support 640 comprises two pressing pieces 641 and two hook 642 extending downward from two opposite edges of each pressing piece 641 respectively. Each pressing piece 641 is provided with an aperture 6411. Each pressing piece 641 is disposed on one of the blood oxygen sensors 630, and a sensing surface of the blood oxygen sensor 630 is exposed from the aperture 6411. The connection block 612 is provided through slots 6121 corresponding to the hooks 642 of the pressing pieces 641, and the lower support 650 is provided with latching slots 651 corresponding to the through slots 6121. In this way, the hooks 642 of the upper support 640 pass through the through slots 6121 and the latching slots 651 and hook the edges of the latching slots 651. Thus, the upper support 640 and the lower support 650 achieve a clamp connection, and the blood oxygen sensors 630 and the connection block 612 are clamped between the upper support 640 and the lower support 650.

Furthermore, in order to ensure that the hooks 642 can be conveniently and quickly inserted into the latching slots 651, the edge of each latching slot 651 is provided with an inclined edge 652. Thus, by the guide function of inclined surfaces, the hooks 642 can quickly enter the slots 651 and hook the bottoms of the inclined edges 652.

In this embodiment, the bottom of the lower support 650 is provided with a fixing column 653, and the upper end of the third elastic member 620 sleeves around the fixing column 653. In this way, the third elastic member 620 is limited by the fixing column 653, which can prevent the elastic member 620 from inclining during stretch and shrink. Preferably, the third elastic member 620 is also a spring.

In this embodiment, two above-mentioned blood oxygen sensors 630 are disposed in one flexible sleeve 610. Of course, one, three, or more blood oxygen sensor 630 may be disposed in the flexible sleeve 610. It should be noted that the blood oxygen sensor 630 may be commercially available and may be any kind. For example, a photoelectric blood oxygen sensor using the photoelectric principle for collection may be used. When the head massager is used, the blood oxygen detecting device 600 clings to eyelids to test the blood oxygen condition, and shows test results by the controller. In this way, users can grasp the blood oxygen situation in real time and adjust the massage.

In this embodiment, when the head massager is used, if the user wants to remove the blinder 300, he/she can toggle the two lock catches 510 back respectively or simultaneously, so that the inserting part 512 on the front portion of each lock catch 510 exits from the lock hole 330 and the pins 321 of the second PCB 320 on the eye housing 310 are separated from the first PCB 120. A magnetic valve disposed in the front shell 100 for controlling air communication of the air bag receives a single and then keeps a closed state. In this way, the eye massage function is stopped but doesn't affect the head massage function. Finally, the pipe joint 311 is pulled out and is separated from the air tap 110, that is, the blinder 300 is removed completely. When the blinder 300 needs to be mounted, the location columns 340 of the eye housing 310 are aligned with the location holes 160 of the front shell 100 and pushed forward. At the moment, under the action of the springs, the two lock catches 510 slide outward. When the location columns 340 are completely pushed into the location holes 160, the lock catches 510 move forward under the push action of the springs and drive the inserting parts 512 thereof slide into the location holes 330 completely. If there is no external force, due to the pressure of the springs, the lock catches 510 themselves cannot slide. In this way, the blinder 300 is fixed on the front shell 100; at this time, the pins 321 on the blinder 300 are electrically connected to the first PCB 120, and the pipe joint 311 communicates with the air tap 110. Both the massage function and the heat function of the blinder 300 are enabled, and the blood oxygen detecting device 600 is started, so that the head massage, the eye massage, and the blood oxygen detection can be performed simultaneously.

In conclusion, the multifunctional head massager of the present invention can simultaneously massage the head and the eyes and detect the blood oxygen, or only massage the head after the blinder is removed. This selectable working mode is more convenient for use.

What described above are only preferred embodiments of the present disclosure but are not intended to limit the scope of the present disclosure, and any modifications, equivalent replacements, and improvements made within the spirit and principle of the present invention should be included in the protection scope of the present invention.

The invention claimed is:

1. A multifunctional head massager comprising:

a helmet including a front shell and a rear shell;

a controller connected to the helmet;

a blinder configured to massage a user's eyes, the blinder is detachably connected to the front shell, a blood oxygen detecting device, wherein the blood oxygen detecting device is accommodated in the front shell or an eye housing, and the blood oxygen detecting device is electrically connected to the controller;

wherein the blood oxygen detecting device comprises a flexible sleeve fixed in the helmet, a sleeve elastic member disposed in the flexible sleeve, and at least one blood oxygen sensor disposed on the third elastic member, wherein an upper open portion of the flexible sleeve is provided with a connection block, the blood oxygen sensor is disposed on the connection block, a lower support is disposed below the connection block, the blood oxygen sensor is provided with an upper support, the upper support passes through the connection block and is engaged with the lower support, the upper support is provided with an aperture, the blood oxygen sensor is exposed from the aperture, and the sleeve elastic member is fixed on the lower support.

2. The multifunctional head massager of claim 1, wherein the blinder comprises a massage airbag accommodated in the eye housing, the eye housing is provided with a pipe joint communicating with the massage airbag, a pump is accommodated in the front shell, the front shell is provided with an air tap communicating with the pump, and the pipe joint is inserted in the air tap.

3. The multifunctional head massager of claim 2, wherein a sealing ring is disposed between the air tap and pipe joint.

4. The multifunctional head massager of claim 2, wherein a first printed circuit board (PCB) is disposed on the front shell, a second printed circuit board (PCB) is disposed on the eye housing, the eye housing is provided with a plurality of pins capable of passing through the second PCB, and the second PCB is electrically connected to the first PCB through the pins, wherein the controller is separated from the first PCB and the second PCB.

5. The multifunctional head massager of claim 4, wherein a top surface of each pin is provided with a contact terminal, a terminal elastic member is accommodated in each contact terminal to press the contact terminal against and thereby electrically connect the contact terminal to the first PCB.

6. The multifunctional head massager of claim 2, wherein each of two end faces of the eye housing is provided with a lock hole, and the front shell is provided with two lock components capable of being inserted in the lock holes.

7. The multifunctional head massager of claim 6, wherein the front shell is provided with a mounting groove, the lock component comprises a lock catch accommodated in the mounting groove and being movable forward and backward, and a catch elastic member disposed behind the lock catch to press against the lock catch; a front portion of the lock catch is provided with an inserting part, and the inserting part extends from the mounting groove and is inserted in the lock hole.

* * * * *